US007475715B2

(12) United States Patent
Gardner et al.

(10) Patent No.: US 7,475,715 B2
(45) Date of Patent: Jan. 13, 2009

(54) OPERATOR FOR INSULATED GLASS ACCESSORY

(75) Inventors: James B. Gardner, Holland, MI (US); Joshua R. Cornish, Holland, MI (US); Benjamin P. Hummel, Cedar Springs, MI (US)

(73) Assignee: ODL, Incorporated, Zeeland, MI (US)

( * ) Notice: Subject to any disclaimer, the term of this patent is extended or adjusted under 35 U.S.C. 154(b) by 258 days.

(21) Appl. No.: 11/463,736

(22) Filed: Aug. 10, 2006

(65) Prior Publication Data

US 2008/0035279 A1 Feb. 14, 2008

(51) Int. Cl.
*E06B 3/32* (2006.01)

(52) U.S. Cl. ..... 160/107

(58) Field of Classification Search ..... 160/84.04, 160/84.05, 84.06, 168.1 R, 172 R, 178.1 R, 160/170, 107, 371; D6/580; 49/64
See application file for complete search history.

(56) References Cited

U.S. PATENT DOCUMENTS

| | | | | |
|---|---|---|---|---|
| 4,588,012 | A * | 5/1986 | Anderson | 160/174 R |
| D457,372 | S | 5/2002 | Sun et al. | |
| 6,601,633 | B2 * | 8/2003 | Sun et al. | 160/107 |
| 6,932,139 | B2 | 8/2005 | Early et al. | |
| 7,337,824 | B2 * | 3/2008 | Berger | 160/107 |
| 2003/0066614 | A1 * | 4/2003 | Sun et al. | 160/107 |
| 2003/0173036 | A1 * | 9/2003 | Kwon et al. | 160/107 |
| 2006/0118250 | A1 * | 6/2006 | Jin et al. | 160/107 |

* cited by examiner

*Primary Examiner*—Blair M. Johnson
(74) *Attorney, Agent, or Firm*—Warner Norcross & Judd LLP

(57) ABSTRACT

A follower for a window accessory within an insulated glass assembly. The follower includes a body having first and second sides adapted to face first and second spaced glazing panels. The follower further includes at least one magnet within each of the two sides, so that the follower will couple with a magnetic operator placed on either of the glazing panels. The follower yet further includes wheels having a diameter larger than the width of the body to rotatably support the follower against either of the glazing panels.

4 Claims, 3 Drawing Sheets

OPERATOR FOR INSULATED GLASS ACCESSORY

BACKGROUND OF THE INVENTION

The present invention relates to insulated glass (IG) accessories, and more particularly to a follower within the IG or operating such accessories.

A variety of IG window accessories have been developed to enhance the aesthetics and functionality of the insulated glass unit. One common accessory is a window blind such as those illustrated in U.S. Pat. No. 6,932,139 issued Aug. 23, 2005 to Early et al and U.S. Pat. No. 6,601,633 issued Aug. 5, 2003 to Sun et al. The blind is located between the glazing panels, and the blind includes an operating mechanism for at least one of 1) raising and lowering the blind and 2) tilting the blind. The operating mechanism includes a magnetic follower within the insulated glass (i.e. between the spaced glazing panels) and a magnetic operator positioned on the exterior surface of one of the panels. The operator and the follower are magnetically coupled through the glazing panel to move together. The blind can be raised and lowered and/or tilted by moving the operator along the glazing panel.

The operator is positioned on the interior glazing panel, so that the blind can be operated from the building interior but not from the building exterior. Consequently, the IG unit is "handed" because the operator must be located during manufacture either at the left or at the right edge of the insulated glass. Consequently, both left-handed IG units and right-handed IG units must be manufactured and inventoried, resulting in significant cost and space requirements.

SUMMARY OF THE INVENTION

The aforementioned problems are overcome by the present invention in which an IG unit includes an unhanded operator and follower for the IG accessory. Two aspects contribute to the unhanded nature of the operator and follower.

In a first aspect of the invention, the follower includes a body having first and second sides adapted to face the first and second glazing panels of the insulated glass. The follower further includes at least two low-friction elements adapted to support the body against either of the spaced glazing panels. Consequently, the operator may be placed on either glazing panel over the follower, and at least one of the low-friction elements will support the follower on that panel. The window can be mounted in a building with either glazing panel facing the interior; the operator can be placed on the interior glazing panel; and the follower can be operated using the operator. In the illustrated embodiment, the low-friction elements are rollers.

In a second aspect of the invention, the follower includes a body having first and second sides adapted to face the first and second spaced glazing panel in an insulated glass. Additionally, the follower includes at least one magnet supported by the first side of the follower and a second magnet supported by the second side of the follower. Consequently, the follower includes at least one magnet facing each of the two glazing panels. Therefore, the operator may be placed on either glazing panel, and the follower will be magnetically coupled with the follower through that panel (i.e. regardless of the panel on which the operator is placed).

The present invention assists in providing an unhanded IG assembly. The IG assembly may be placed in the building opening with either of the glazing panels facing inwardly. The operator may be placed on the interior glazing panel. The first aspect of the invention ensures that the follower will be supported on the "interior" glazing panel for easy movement, and the second aspect of the invention ensures that adequate magnetic coupling will occur between the follower and the operator. Consequently, only a single insulated glass assembly needs to be manufactured and inventoried, reducing cost and space.

These and other objects, advantages, and features of the invention will be more fully understood and appreciated by reference to the description of the current embodiment and the drawings.

DESCRIPTION OF THE CURRENT EMBODIMENT

Figure 1:
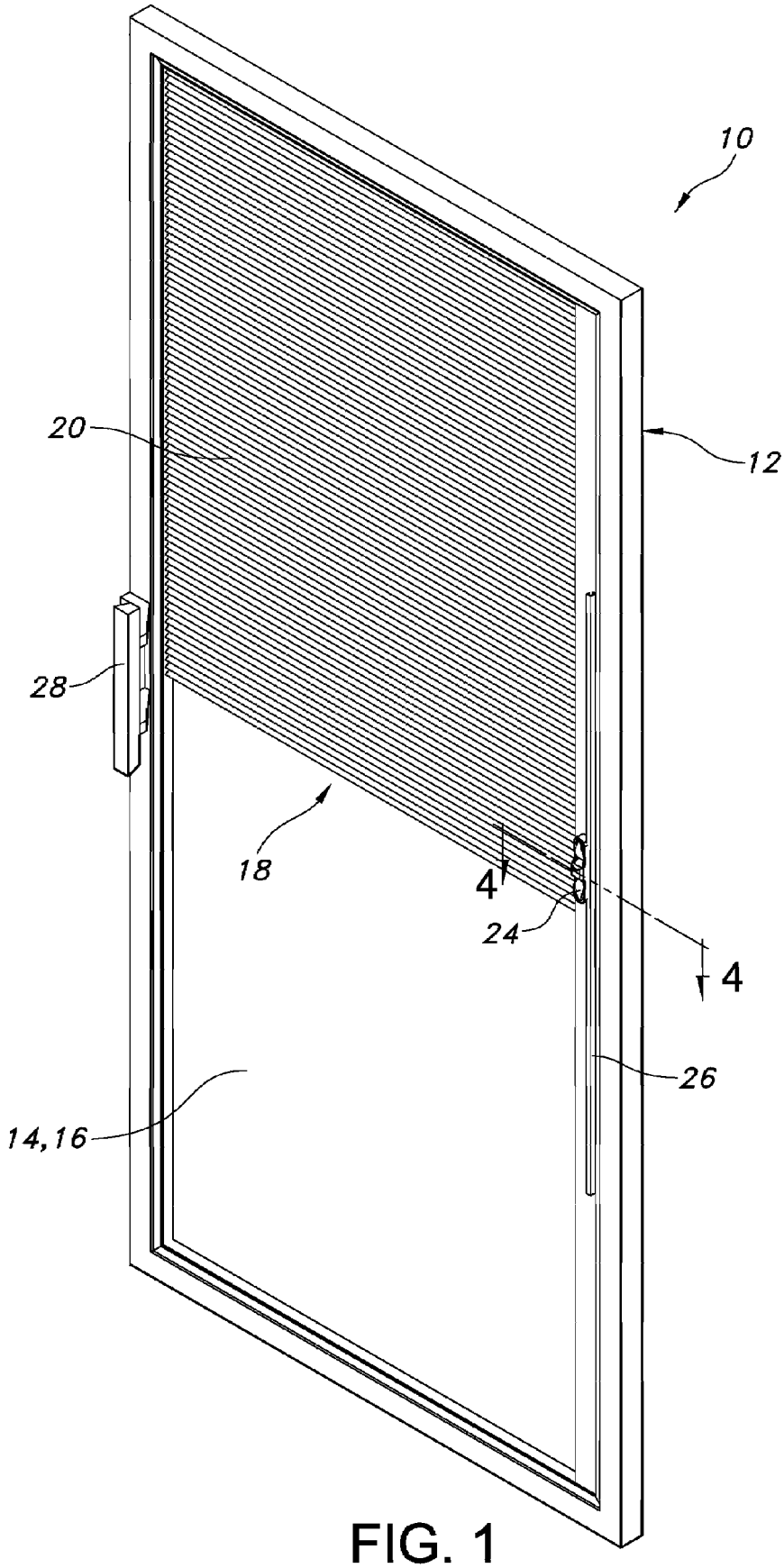
FIG. 1 is a perspective view of an insulated glass assembly including an IG blind.
Figure 2:
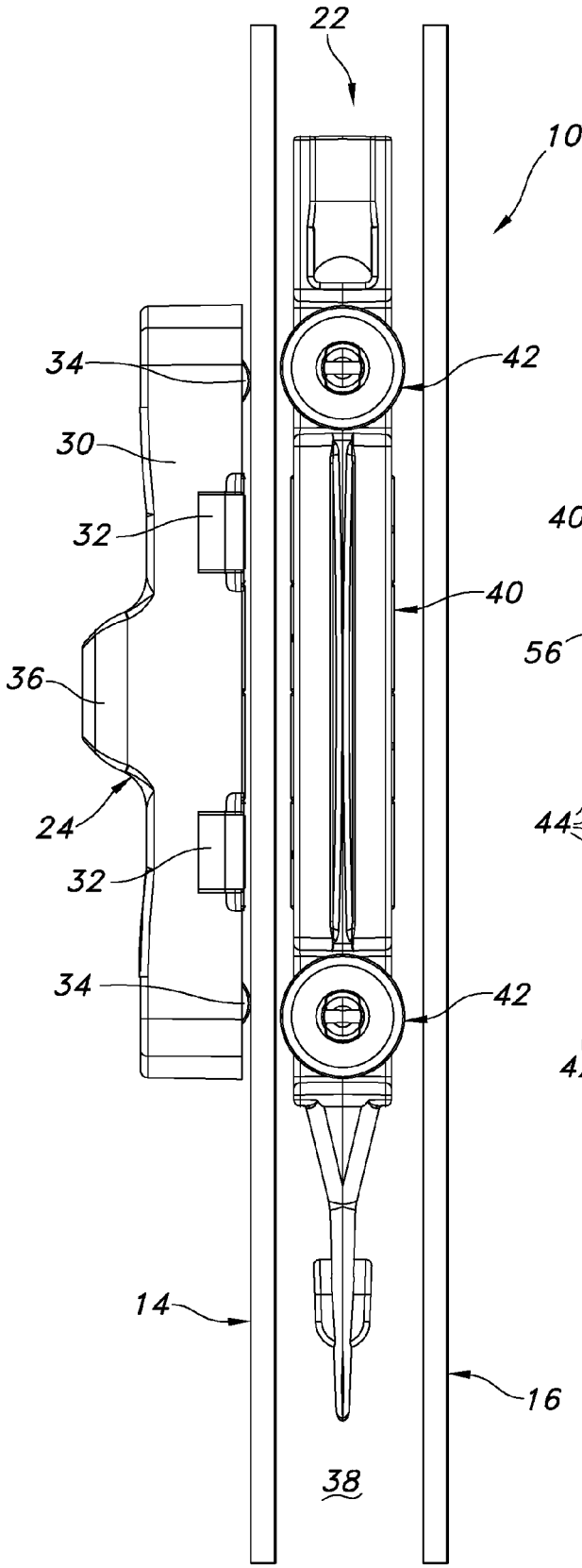
FIG. 2 is a sectional view showing the glazing panels, the follower, and the operator.
Figure 3:
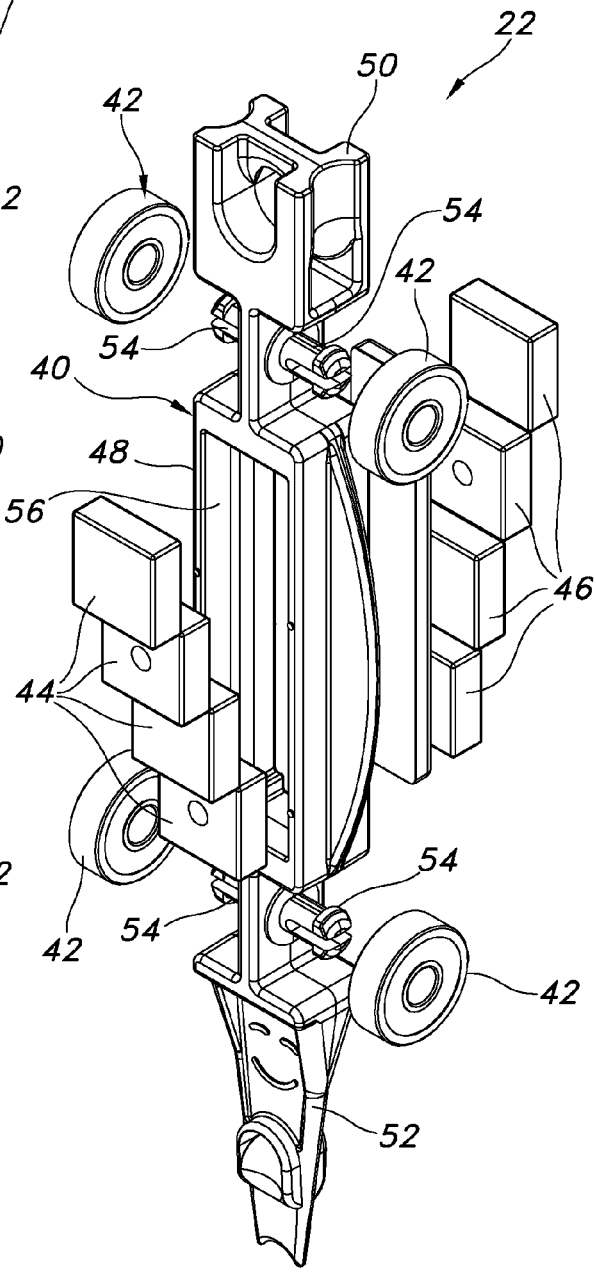
FIG. 3 is a perspective, exploded view of the follower.

An insulated glass assembly constructed in accordance with a current embodiment of the present invention is illustrated in FIGS. 1-2 and generally designated 10. The IG assembly 10 is supported within a frame 12. The assembly includes a pair of glazing panels 14, 16, and an insulated blind assembly 18. The blind assembly in turn includes a set of slats 20 carried by an operator mechanism not fully illustrated. The mechanism includes a follower 22 (FIGS. 2-3), an operator 24 (FIGS. 1-2), and a track 26 (FIG. 1). The follower 22 and the operator 24 are magnetically coupled through the glazing panel 14. (Alternatively, depending on the IG assembly's orientation, the follower and the operator could be magnetically coupled through the glazing panel 16 as will be described.) The operator 24 rides within and/or is guided by the track 26. As the operator 24 is slid along the IG assembly, the follower 22 follows the operator. Movement of the follower 22 raises, lowers, and/or tilts the blind slats 20.

Figure 4:
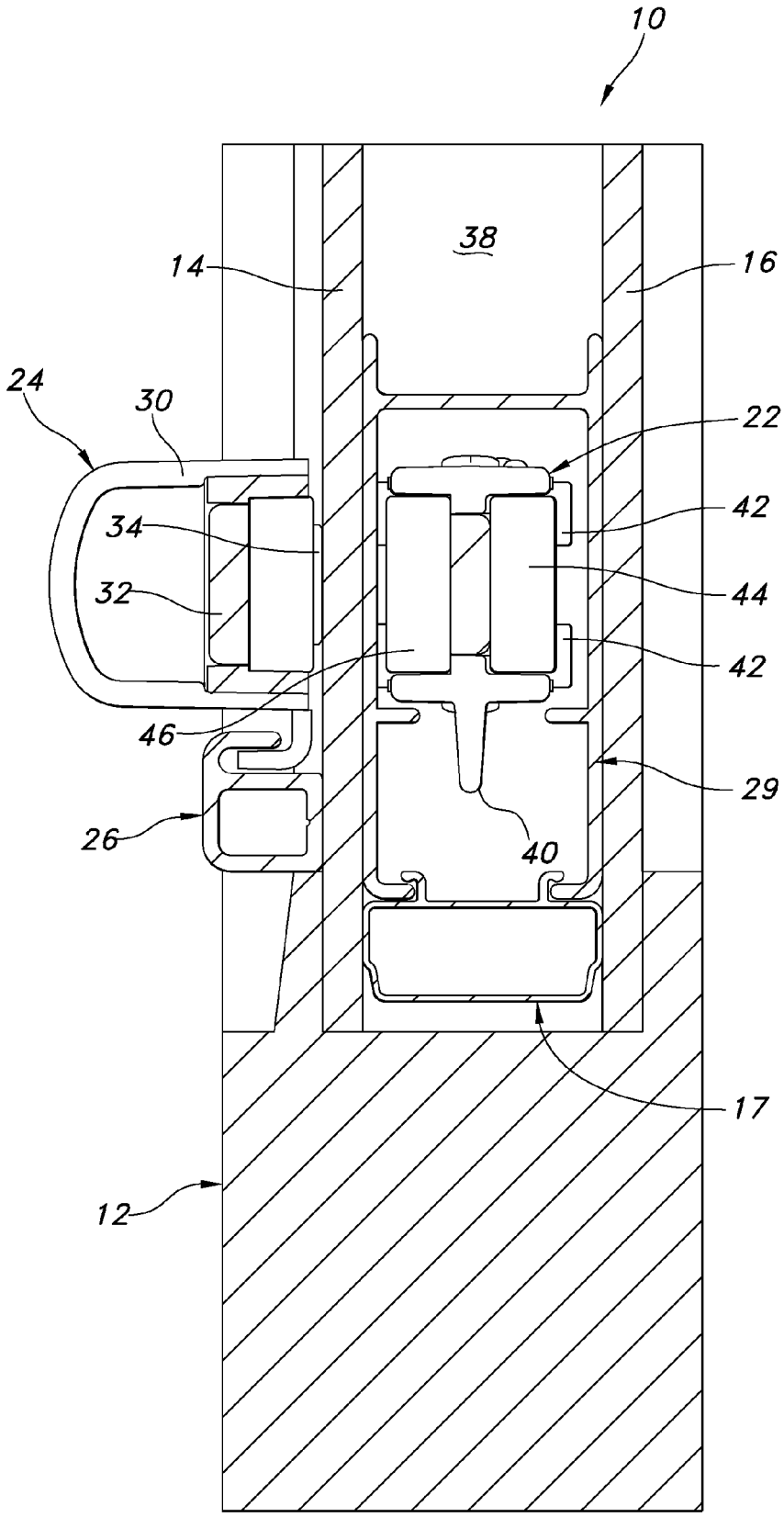
FIG. 4 is a fragmentary sectional view taken along line 4-4 in FIG. 1.

The IG assembly 10 and the frame 12 are known to those skilled in the art. Consequently, a detailed description of the construction and assembly of these components is unnecessary. The IG assembly 10 includes the spaced glazing panels 14, 16 and a spacer 17 (see FIG. 4) therebetween. As illustrated in the current embodiment, the IG assembly 10 and the frame 12 together comprise a patio door having a handle 28 mounted on one side of the frame 12. The insulated glass could be incorporated into a variety of constructions such as a door, a window, a door glass, a sidelight, a skylight, any other window assembly.

With the exception of the follower 22, the IG blind assembly 18 also is well-known to those skilled in the art. The blind assembly includes a plurality of slats 20 supported on cords, strings, or any other operating mechanism (not fully illustrated). The cords can be operated to raise and lower the blind and/or to tilt the slats within the blind. While the illustrated IG accessory is the blind assembly 18, the accessory could be any other suitable accessory such as a pleated shade, another window covering, or other construction.

A PVC (polyvinylchloride) extrusion 29 (FIG. 4) is secured to the spacer 17 in the space 38 between the glazing panels 14, 16. The follower 22, cords (not shown), and/or other operator components (not shown) are located inside the extrusion 29 so as to be hidden from view. The extrusion 29 is an optional component, but currently desired for aesthetic reasons. If the extrusion 29 is included (as illustrated), then the follower engages the extrusion. If the extrusion 29 is not included, then the follower engages the glazing panels. For the remainder of this application, a reference to the follower engaging either or both glazing panels is intended to include both options—with and without the extrusion 29.

The operating mechanism includes the follower 22, the operator 24, and the track 26. Both the operator 24 and the track 26 are well-known to those skilled in the art.

The track 26 is mounted on one of the glazing panels 14, 16, the frame 12, or any other portion of the IG assembly. The track is mounted on the "interior" side of the IG assembly (i.e. the side that faces the building interior), typically after that side is selected by installing the assembly within a building. While the track 26 in the current embodiment is a separate element, the track may be incorporated into another component of the insulted glass assembly 10 such as the frame 12.

As perhaps best illustrated in FIG. 2, the operator 24 includes a body 30 that supports one or more magnets 32 and two or more rollers or wheels 34. The body 30 rides along the surface of the "interior" glazing panels 14 on the roller elements 34. The magnets 32 magnetically couple the operator 24 with the follower 22. The body 30 includes a grasping portion 36 or other physical feature to facilitate movement of the operator. One suitable operator body is illustrated in U.S. Pat. No. D457,372 issued May 21, 2002 to Sun et al.

The follower 22 (FIGS. 2-3) is located within the space 38 defined between the spaced glazing panels 14, 16, and more particularly within the extrusion 29. The follower 22 includes a body 40, a plurality of low-friction elements 42, one or more first magnets 44, and one or more second magnets 46. In the current embodiment, the low-friction elements 42 are rollers or wheels. However, other low-friction means or low-friction elements could be used. For example, the elements could be pieces of a static material such as that sold by Igus, Inc. of East Providence, R.I. under the DRYLIN trademark. For this application, "low-friction means," "low-friction elements," and "roller elements" are used interchangeably, and are intended to include all low-friction elements.

The follower body 40 is a single piece of injection molded plastic, but may be fabricated of any suitable material using any suitable technique. The body 40 includes two sides—a first side facing the glazing panel 14 and a second side facing the glazing panel 16. The structure of the body 40 includes a central portion 48, an upper connector portion 50, a lower connector portion 52, and a plurality of stub axles 54.

When the low-friction elements are wheels (as illustrated), the wheels 42 are rotatably supported on the follower body 40. More specifically, one wheel 42 is rotatable mounted on each of the stub axles 54 by snap-fitting the wheel onto the axle. As illustrated in FIG. 2, the diameter of the wheels 42 is greater than the width of the body 40 between the first and second sides. Consequently, the wheels engage either of the glazing panels 14, 16 to prevent the body 40 from engaging either glazing panel.

The central portion 48 defines a first magnet cavity 56 in the first side of the body 40 and a second magnet cavity (not visible) in the second side of the body. The first magnets 44 are supported within the magnet cavity 56 on the first side of the follower, and the second magnets 46 are supported within the corresponding magnet cavity on the second side of the magnet follower. Each plurality of magnets in the current embodiment is arranged in a linear configuration. The magnets currently are secured in position using any suitable means such as adhesive, adhesive tape, and/or friction.

The connector portions 50 and 52 provide a means for connecting the follower body 40 to the remainder of the blind operator mechanism (not shown). Specifically, cords, strings, springs, and/or other components may be attached to the connector portions 50, 52.

Assembly, Installation and Operation

The IG assembly 10 is manufactured and assembled using conventional techniques. In particular, the follower 22 is installed within the space 38 between the spaced glazing panels 14 and 16. The IG assembly may be installed within a building opening with either of the glazing panels 14, 16 facing inwardly. Consequently, the IG assembly is "unhanded" because the operator can be installed on the "interior side" after the IG assembly has been installed in the building. After the interior side has been determined by the installation, the track 26 is mounted on the IG assembly 10, and the operator 24 is interfitted with the track 26 over the follower 22. The operator 24 and the follower 22 are magnetically coupled, and the wheels 42 are drawn into engagement with the glazing panel 14, 16 that faces the interior. Therefore, the wheels 42 provide rotatable support for the follower 22 on the glazing panel 14, 16.

The above description is that of a current embodiment of the invention. Various alterations and changes can be made without departing from the spirit and broader aspects of the invention as define in the appended claims, which are to be interpreted in accordance with the principles of patent law including the doctrine of equivalents.

The invention claimed is:

1. An insulated window assembly comprising:

first and second glazing panels defining a space therebetween;

a magnetic operator adapted to be placed on either of said glazing panels outside of said space; and a window accessory at least partially within said space, said window accessory including a magnetic follower within said space, said follower including a body having a first side facing said first glazing panel and a second side facing said second glazing panel, said operator and said follower magnetically coupled to one another, said follower further including low-friction means for supporting said follower against either of said first panel or said second panel depending on the placement of said operator;

wherein said low-friction means includes a plurality of roller elements and each of said roller elements includes a first portion extending beyond said first side and a second portion extending beyond said second side.

2. An insulated window assembly as defined in claim 1 wherein:

the first and second sides define a width therebetween; and the diameter of each of said roller elements is greater than said width.

3. An insulated window assembly as defined in claim 2 wherein each of said roller elements comprises a wheel.

4. An insulated window assembly as defined in claim 1 where said follower further includes a first magnet supported by said first side and a second magnet supported by said second side.

* * * * *